US008070387B2

(12) United States Patent
Schaaf

(10) Patent No.: US 8,070,387 B2
(45) Date of Patent: Dec. 6, 2011

(54) SHORELINE STABILIZATION, RESTORATION, AND RUNOFF FILTRATION

(75) Inventor: Daniel Schaaf, Centuria, WI (US)

(73) Assignee: Daniel Schaaf, Centuria, WI (US)

( * ) Notice: Subject to any disclaimer, the term of this patent is extended or adjusted under 35 U.S.C. 154(b) by 344 days.

(21) Appl. No.: 12/399,287

(22) Filed: Mar. 6, 2009

(65) Prior Publication Data

US 2009/0232599 A1 Sep. 17, 2009

Related U.S. Application Data

(60) Provisional application No. 61/036,337, filed on Mar. 13, 2008.

(51) Int. Cl.
*E02B 3/12* (2006.01)

(52) U.S. Cl. ..... 405/16; 405/17; 405/18; 405/19

(58) Field of Classification Search ..... 405/16–19, 405/32, 34

See application file for complete search history.

(56) References Cited

U.S. PATENT DOCUMENTS

| | | | | |
|---|---|---|---|---|
| 1,039,579 | A * | 9/1912 | Neames | 405/19 |
| 4,690,585 | A * | 9/1987 | Holmberg | 405/19 |
| 4,919,567 | A * | 4/1990 | Sample | 405/19 |
| 5,007,766 | A * | 4/1991 | Freed et al. | 405/24 |
| 5,257,878 | A * | 11/1993 | Peterson | 405/15 |
| 5,951,202 | A * | 9/1999 | Brown | 405/19 |
| 6,679,151 | B1 * | 1/2004 | Rexroad | 87/6 |
| 6,913,423 | B2 * | 7/2005 | Spangler et al. | 405/302.6 |
| 7,811,029 | B2 * | 10/2010 | Graham et al. | 405/17 |

OTHER PUBLICATIONS http://www.nagreen.com/erosion-control-products/photodegradable-erosion-control.php North Amreican Green Inc.—Photodegradable products for sale on website.* www.kplic.co.kr/ Korea Petrochemical Inc. Co. Ltd.—Manufacturers of Yuhwa Polypro 1077 photodegradeable polymer.*

North American Green: Keeping Soil on the Golf Course—vol. 6 No. 1—Feb. 2000.*

North American Green: Sand Dune Stabilization and Beach Erosion Control—vol. 1 No. 1.*

* cited by examiner

*Primary Examiner* — Frederick L Lagman
*Assistant Examiner* — Kyle Armstrong
(74) *Attorney, Agent, or Firm* — Schwegman, Lundberg & Woessner, P.A.

(57) ABSTRACT

Various embodiments described herein provide shoreline restoration modules which may be anchored together along a shoreline of a body of water, such as a lake or pond, to facilitate restoration of the shoreline. The shoreline restoration modules may include a photodegradable material selected to degrade over a period of years, such as four years or five years, while maintaining strength over the period of years to prevent breakdown of a media enclosed by the shoreline restoration modules. In some embodiments, the shoreline restoration modules also provide beneficial run off nutrient, silt, and other particulate matter trapping and filtering.

16 Claims, 6 Drawing Sheets

SHORELINE STABILIZATION, RESTORATION, AND RUNOFF FILTRATION

CROSS-REFERENCE TO RELATED APPLICATIONS

The present application claims the benefit of priority to U.S. Provisional Application Ser. No. 61/036,337, filed Mar. 13, 2008, which is incorporated by reference in its entirety.

BACKGROUND INFORMATION

Shorelines surrounding many bodies of water have become unhealthy in recent years. The unhealthy nature of shorelines, such as shorelines surrounding ponds and lakes have suffered due to many reasons such as residential and commercial development, increased amounts of runoff dues to non-permeable surfaces, loss and removal of native shoreline vegetation, and many other reasons.

Unhealthy shorelines often result in deteriorating water conditions that are harmful to aquatic life. Absent healthy shorelines, silt, nitrates, phosphates, and other soluble and particulate matter are often able to flow unrestricted in bodies of water. These bodies of water may fill with silt and particulate matter, which may damage the ecosystem for aquatic life. Aquatic ecosystems may also be damaged, or otherwise altered form a healthy state, increasing algae growth and other invasive plants and aquatic life to flourish. The result is often an unhealthy body of water that not only disrupts or destroys naturally occurring aquatic ecosystems, but also disrupts recreation and other uses of these altered bodies of water.

DETAILED DESCRIPTION

Various embodiments described herein provide shoreline restoration modules, which may be anchored together along a shoreline of a body of water, such as a lake or pond, to facilitate restoration of the shoreline. The shoreline restoration modules include at least a photodegradable material selected to degrade over a period of years, such as four years or five years, while maintaining strength over the period of years to prevent breakdown of a media enclosed by the shoreline restoration modules.

In some embodiments, the shoreline restoration modules are filled with a media bale, such as a bale made primarily or entirely of cornstalks. The cornstalk bales, or other suitable media, when saturated by water, retain water for rather long duration when enclosed within a shoreline restoration module. This water retention allows replanted vegetation to continuing growing, or at least maintains life, under conditions when waters levels of a body of water recede from the shoreline restoration module.

The cornstalk bales, or other suitable media, when installed along a shoreline also operate to filter runoff of fertilizers, silt, and other particulate matter and chemicals. The cornstalk bales retain and/or restrain such matter preventing contamination of the body of water. There are also many other benefits, of these and other embodiments, that are readily apparent and are described herein.

In the following detailed description, reference is made to the accompanying drawings that form a part hereof, and in which is shown by way of illustration specific embodiments in which the inventive subject matter may be practiced. These embodiments are described in sufficient detail to enable those skilled in the art to practice them, and it is to be understood that other embodiments may be utilized and that structural, logical, and electrical changes may be made without departing from the scope of the inventive subject matter. Such embodiments of the inventive subject matter may be referred to, individually and/or collectively, herein by the term "invention" merely for convenience and without intending to voluntarily limit the scope of this application to any single invention or inventive concept if more than one is in fact disclosed.

The following description is, therefore, not to be taken in a limited sense, and the scope of the inventive subject matter is defined by the appended claims.

Figure 1:
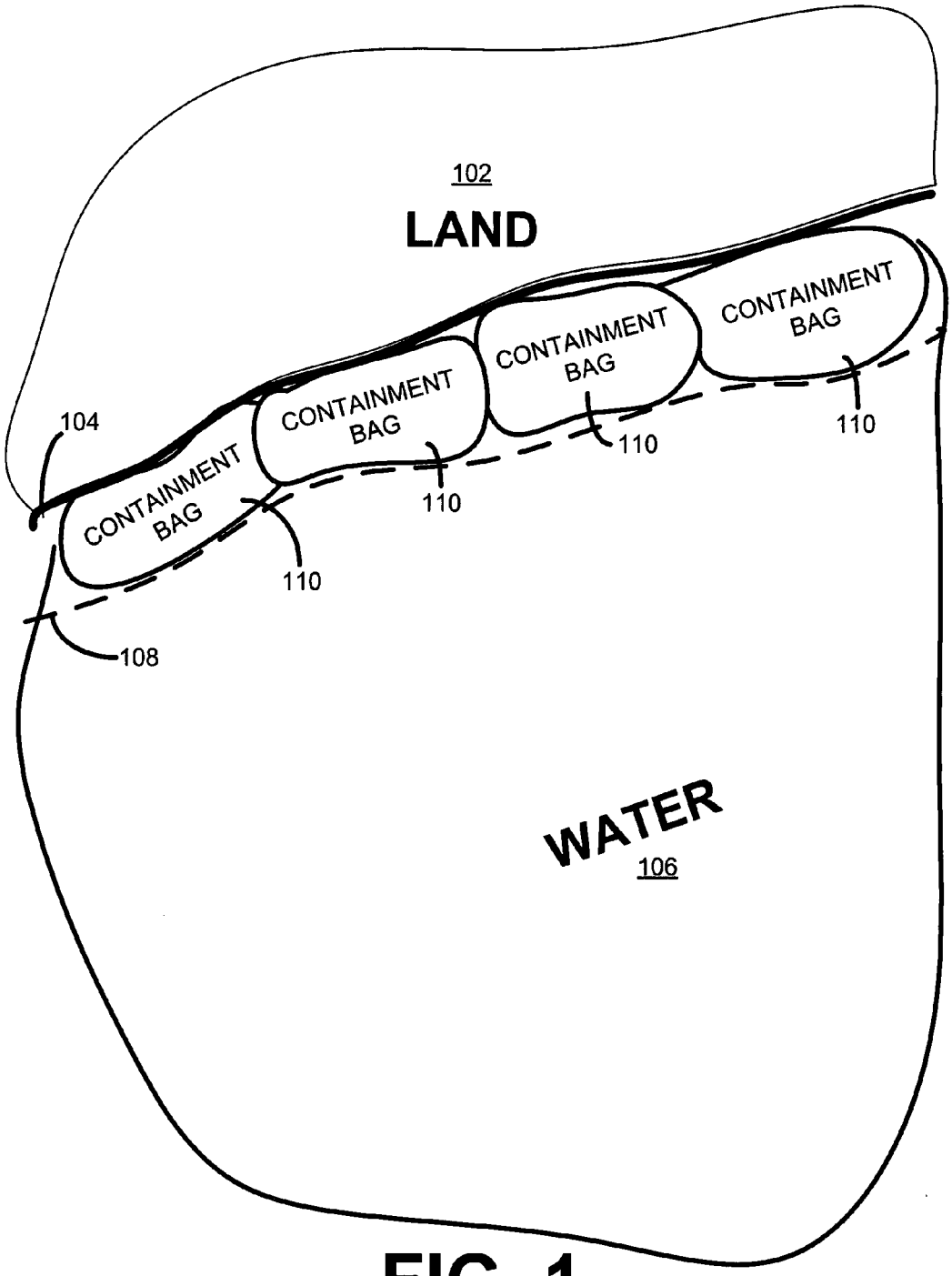
FIG. 1 illustrates a restored shoreline according to an example embodiment.

FIG. 1 illustrates a restored shoreline according to an example embodiment. FIG. 1 includes land 102, water 106, such as a lake, and a shoreline 104. The shoreline 104 is a location where the water 104 abuts the land 102 or has eroded due to water 102, wind, ice heaving, or other causes.

Figure 3:
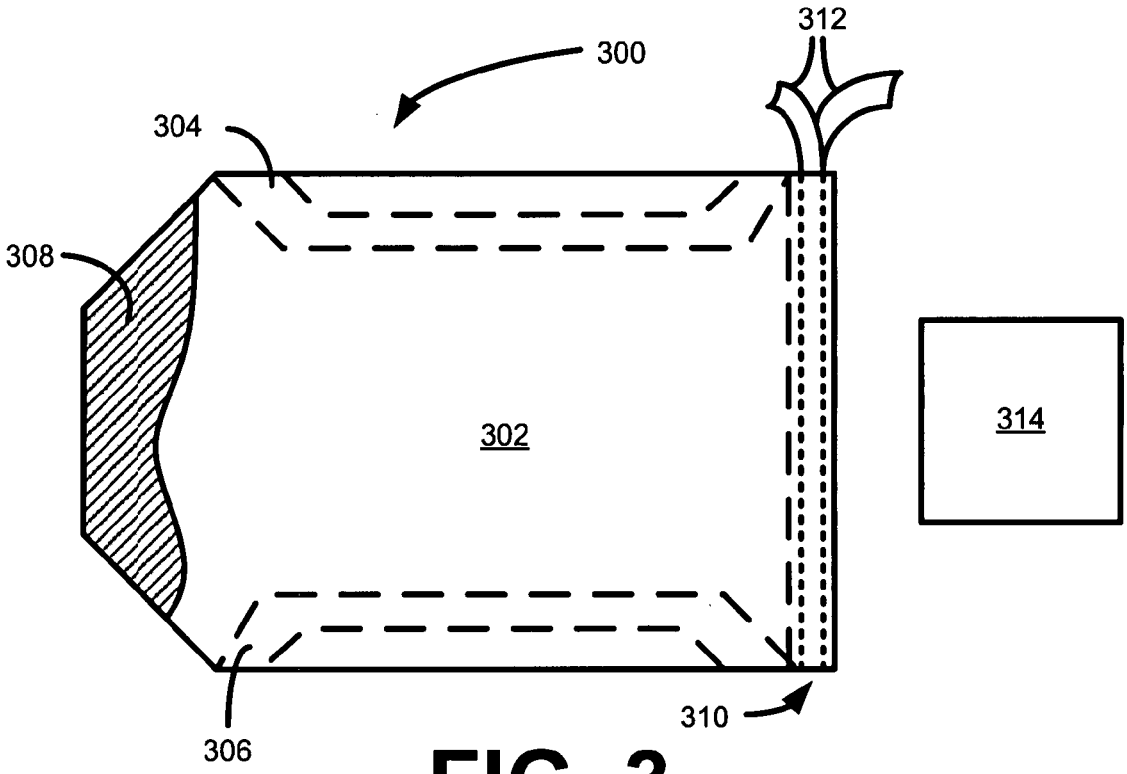
FIG. 3 illustrates an unstuffed media containment bag according to an example embodiment.
Figure 4:
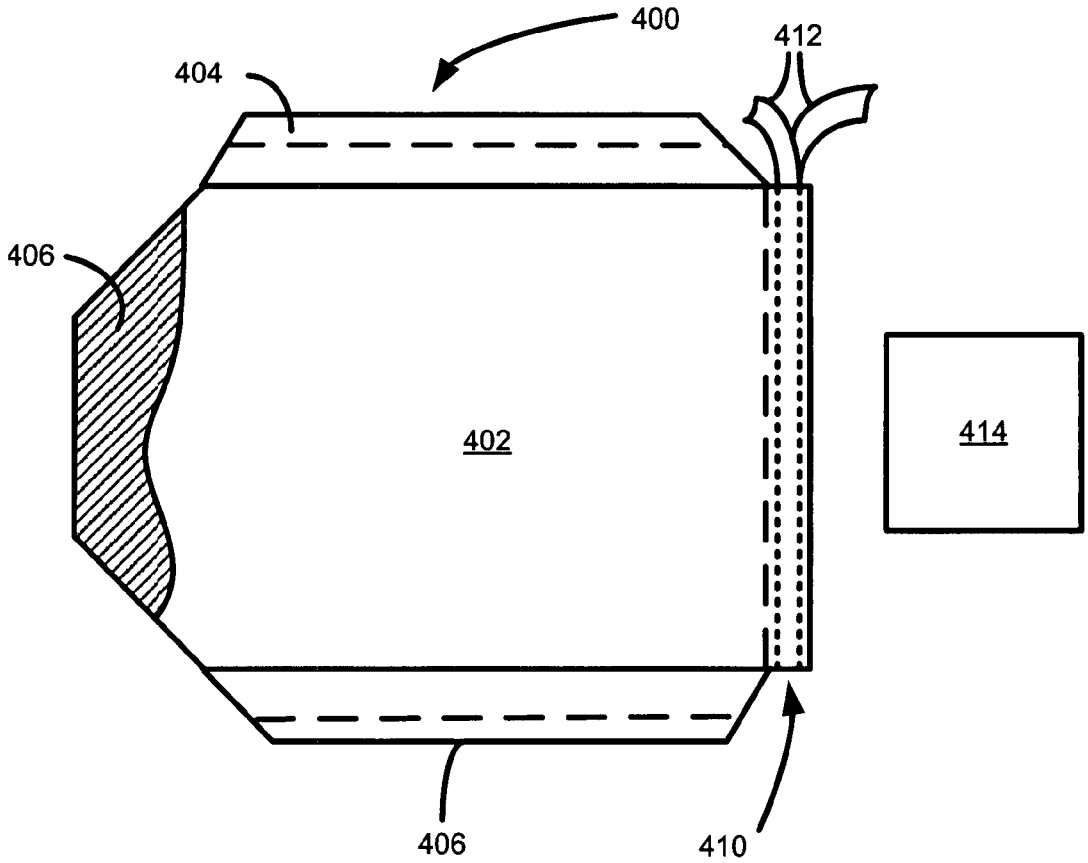
FIG. 4 illustrates an unstuffed media containment bag according to an example embodiment.

FIG. 1 also includes containment bags 110, which are alternatively referred to herein and by others as shoreline restoration modules, bags, socks, and the like. The containment bags 110, in some embodiments, may be installed along the shoreline 104 and backfilled between the land and the containment bags to restore the shoreline 104 to a restored shoreline 108. In some embodiments, as illustrated in FIG. 3 and FIG. 4, the containment bags 110 may include a fabric bag filled with a media, such as one or more of cornstalk, hay, straw, jute, and other organic and inorganic materials. The containment bags 110, when filled with a media, are installed along the shoreline 104 and anchored, such as by using ropes threaded through anchoring channels formed in the fabric bags and secured to stakes driven into the shoreline 104 or land 102. The use of the multiple containment bags 110 in a linear, and sometimes vertical, configuration anchored along the shoreline 104 allows substantial conformity to commonly irregular terrain along shoreline 104.

Figure 2:
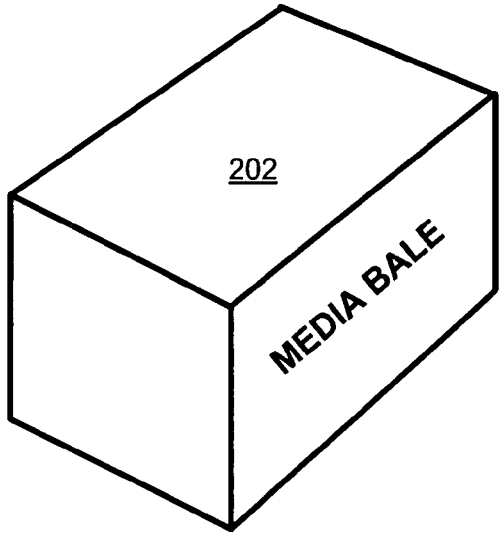
FIG. 2 illustrates a media bale according to an example embodiment.

FIG. 2 illustrates a media bale 202 according to an example embodiment. The media bale 202, in some embodiments, is a cornstalk bale of a size that may be made using convention farming equipment, often referred to as a bailer. The media bale 202 may also be formed of one or more of cornstalk, hay, straw, grasses, other harvested plants, and other natural and man made materials capable of absorbing and retaining water. In some embodiments, the media is selected based on properties such as water retention length, speed of decomposition, heat retention, and other properties that may affect growing properties of shoreline 104 plants that may be planted or may otherwise spread into the media bale 202 when installed.

FIG. 3 illustrates an unstuffed media containment bag 300 according to an example embodiment. The media containment bag 300 is formed of a first fabric 308 and a second fabric 302 having a closed end 307 and an open end 303. The first fabric 308 forms a lining of the bag 300 and the second fabric 302 forms and exterior surface of the bag 300. The bag 300 includes a first anchoring channel 304 and second anchoring channel 306 formed from one or more of the first fabric 308 and the second fabric 302 through which an anchoring line may be threaded. The bag 300 also includes a drawstring channel 310 formed from one or more of the first fabric 308 and the second fabric 302 at the open end 303 of the bag 300. The drawstring channel 310 includes a drawstring 312 threaded there through to substantially close the open end 303 of the bag 300.

In some embodiments, the first fabric 308 is a burlap fabric. The burlap fabric may be an untreated ten-ounce burlap fabric including jute and/or other fibers.

The second fabric 302, in some embodiments, is a photodegradable fabric. The photodegradable fabric may be a woven polymer-based fabric, such as a propylene-based fabric. The photodegradable, woven polymer-based fabric may be selected based on a shade factor of the fabric, such as a shade factor of 60 percent, 65 percent, 70 percent, 75 percent, 80 percent, or other shade factor percent. The shade factor percent may be selected based on factors that may affect growing conditions such as airflow, interplay with water retention properties of a media bale installed within the bag 300, sunlight allowed through to a media bale, abilities of grasses and other plants to spread into and grow through the bag, and other factors depending on the requirements of a particular installation. The photodegradable, woven polymer-based fabric, in some embodiments, has a weight of 4.25 ounces per square yard. In some embodiments, the photodegradable, woven polymer-based fabric is Yuhwa Polypro 1077 manufactured by Korea Petrochemical Inc. Co. Ltd. of Ulsan Korea.

The second fabric 302, in some embodiments, is of a color, such as a light to medium tan color, that is selected based on solar absorption and reflectance properties. For example, as shoreline plants spread into or are planted in the bag 300, when installed, a highly reflective color and/or surface, such as white, may cause too much sunlight to be reflected back onto the plants causing sunburn, wilting, and overheating. If the color of the second fabric 302 is black, the bag 300 and a media bale installed therein may become hot to a point to inhibit plant growth.

The drawstring 312, in some embodiments, is a one-eighth (⅛) inch diameter diamond braid, multifilament, polypropylene rope. However, other ropes of other materials may be used in other embodiments.

In some embodiments, when the open end 303 of the bag 300 is closed using the drawstring 312 may still have a relatively small opening on the open end 303. This opening, in some embodiments, may allow material from a media bale installed in the bag 300 to be shed. To overcome this issue, in some embodiments, an end-cap 314 formed of at least the same material as the second fabric 302 to be placed inside the open end 303 of the bag 300 when closed using the drawstring 312. The drawstring 312, when used to close the open end 303, causes the bag 300 to apply pressure to the end-cap 314 keeping it in place. However, in other embodiments, the drawstring 312 may be used to tie-off the bag 300 in a manner to fully close the open-end 303 of the bag 300.

FIG. 4 illustrates an unstuffed media containment bag 400 according to an example embodiment. The example embodiment of the media containment bag 400 includes similar elements as the media containment bag 300 of FIG. 3. However, the media containment bag 400 includes first anchoring channel 404 and second anchoring channel 406 that extend outward from the media containment bag 400. In contrast, the first anchoring channel 304 and the second anchoring channel 306 extend inward into an interior of the bag 300 illustrated in FIG. 3.

In some embodiments, the first anchoring channel 404 and the second anchoring channel 406 of the bag 400 of FIG. 4 may instead be a series of loops through which an anchoring rope may be threaded. Thus, when an anchoring channel is outside the interior of the bag 400, the term "anchoring channel" should be construed to include a series of loops. Further loops may also be attached to other exterior locations of the bag 400 to facilitate further anchoring as may be needed, otherwise deemed necessary, or used in a particular installation, such as is illustrated in FIG. 1 and FIG. 6.

Figure 5:
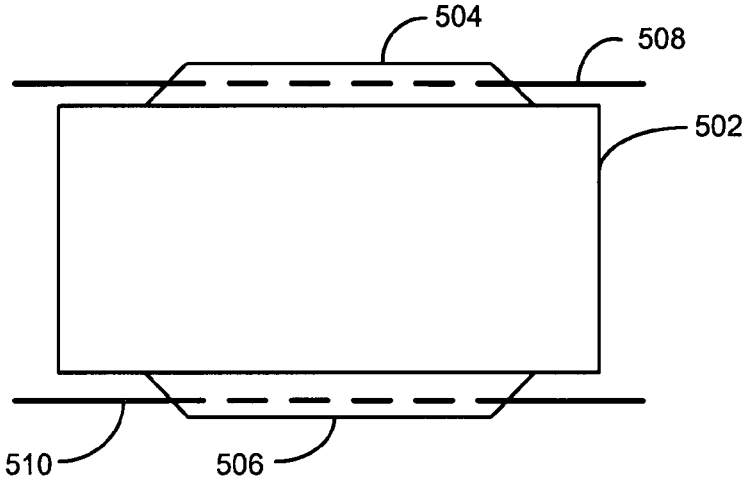
FIG. 5 illustrates a stuffed media containment bag including anchoring elements according to an example embodiment.

FIG. 5 illustrates a stuffed media containment bag 502 including anchoring elements according to an example embodiment. The anchoring elements include a first anchoring channel 504 and a second anchoring channel 506. A first anchoring rope 508 is threaded through the first anchoring channel 504. A second anchoring rope 510 is threaded through the second anchoring channel 506. The first anchoring channel 504 and second anchoring channel 508, in some embodiments, are intended to be located approximately centered between the shorter dimensions of a rectangular side of a media bale when inserted and secured within the bag 502.

Figure 6:
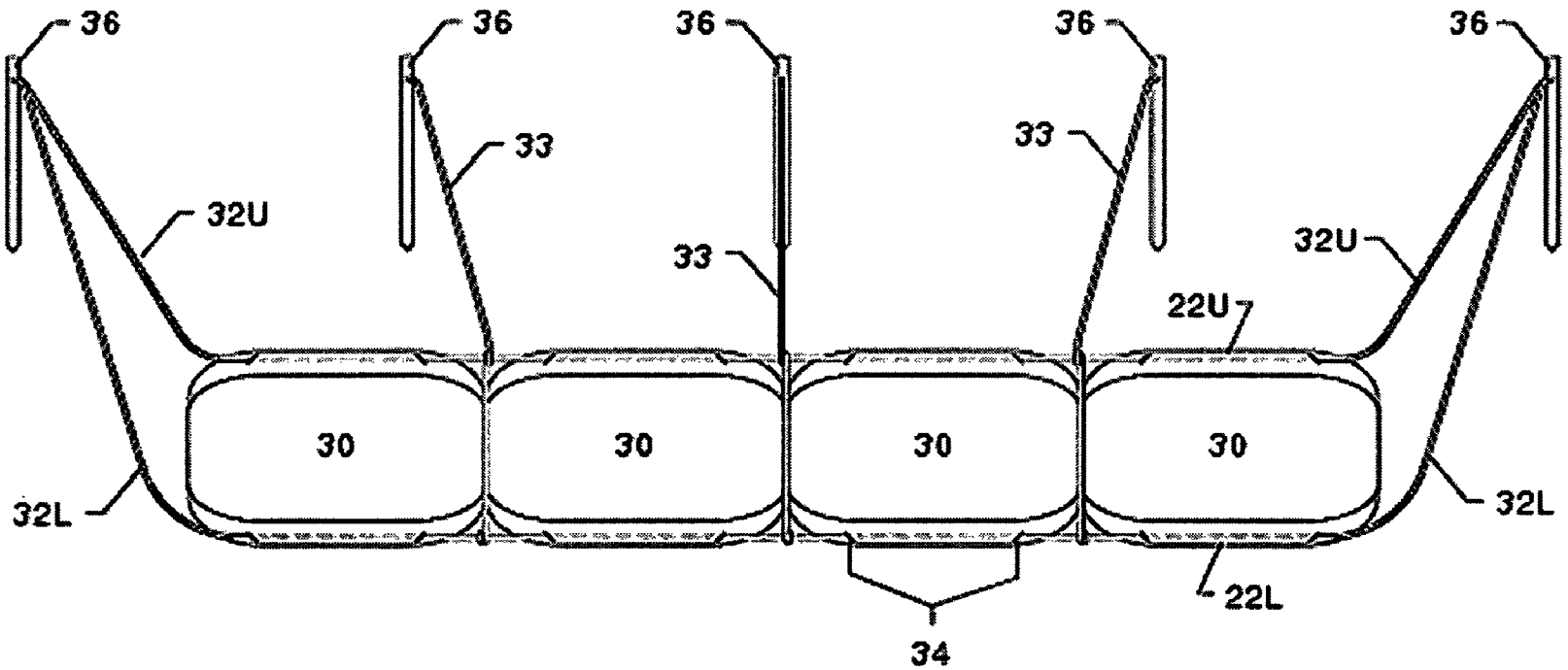
FIG. 6 illustrates multiple stuffed media containment modules including an anchoring system according to an example embodiment.

FIG. 6 illustrates multiple stuffed media containment modules including an anchoring system according to an example embodiment. To secure the overall system, in some embodiments, filled modules 30, two or more independent anchor ropes 32U, 32L (where "U" is upper and "L" is lower) are threaded though the integrated anchoring channels 22U, 22L of a given module 30. Multiple modules 30 may be installed and connected together though use of the two or more independent anchoring ropes 32U, 32L to join a number of modules deemed necessary to cover a section of shoreline to be protected and restored. The independent anchor ropes 32U, 32L are then brought into tension and secured in a conforming nature to the terrain of the shoreline using stakes 36, or a fixed object such as a tree, large boulder, or other object or structure. Stakes 36, which may be wooden, such as oak, are typically driven into a depth beneath the surface to ensure minimal puncture potential if the stakes are located close to the containment modules 30 and/or to keep the anchoring ropes in a position where they are less likely to be tripped over or snagged and pulled by a piece of equipment, tool, person, animal, or other moving thing.

Once the section is secured at both ends, further securing may be made to the shoreline by staking between the modules 30 or in the middle of one or more modules 30. This additional securing may be performed using another length of rope 33, securing the rope 33 to one or more of the anchoring ropes 22U, 22L and bringing the rope 33 into tension using an additional stake 36. The number and frequency of the additional ropes 33 may be chosen an installed based on the overall terrain of the shoreline. The containment modules 30 may also be stacked and secured to each other in situations where a vertical height greater than the height of a single containment module 30 is needed.

The length of a given section of containment modules 30, such as is illustrated in FIG. 6, may vary depending on a variety of factors depending on the shoreline to be restored.

Sections can be lengthened and shortened such as when reaching the end of a property line, an obstruction, and the like. In some embodiments, containment modules may be closed at a various lengths. Thus, the containment modules 30 may be used to adapt to virtually any terrain, obstructions, and other factors.

Figure 7:
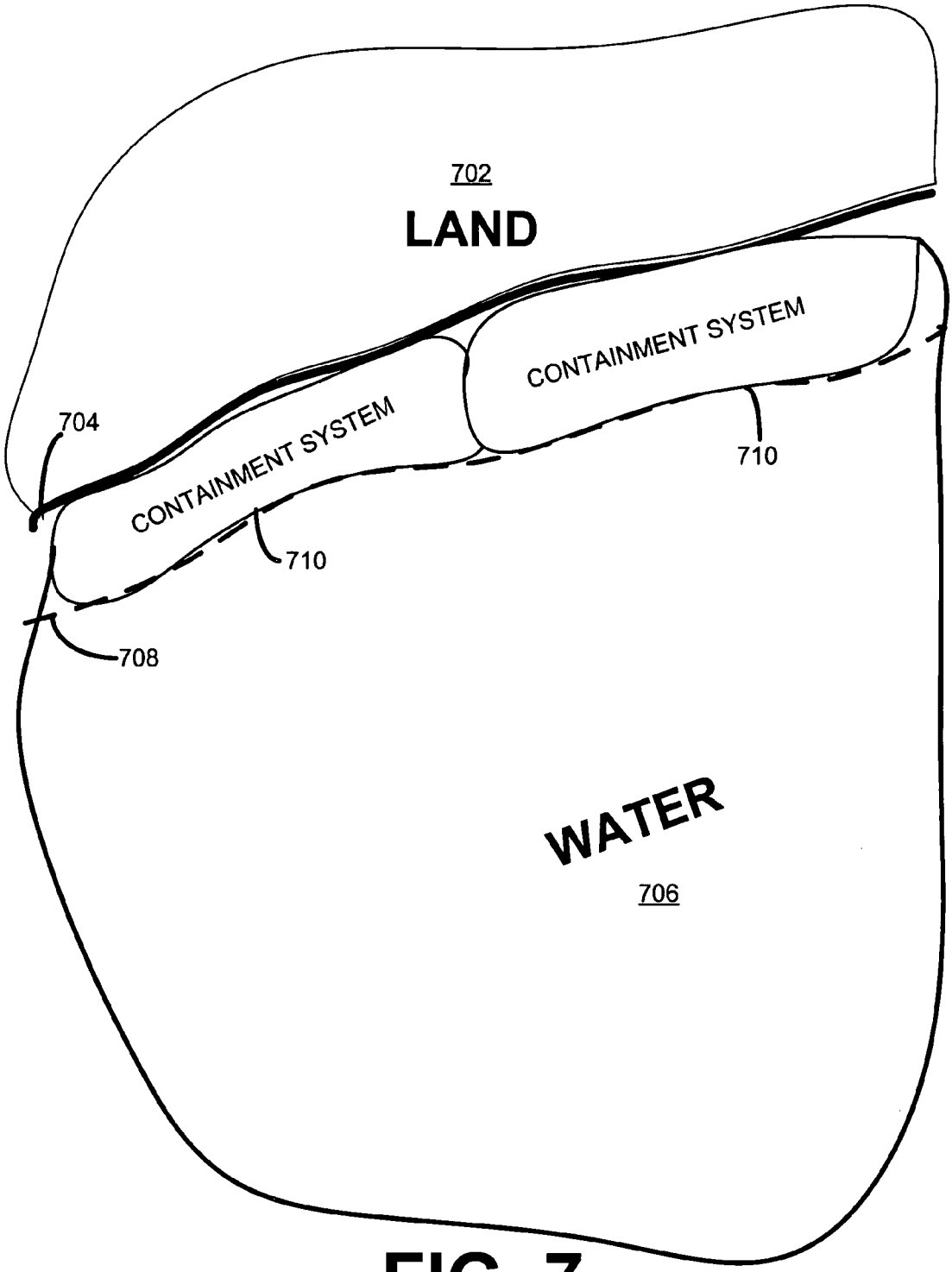
FIG. 7 illustrates a restored shoreline according to an example embodiment.

FIG. 7 illustrates a restored shoreline according to an example embodiment. FIG. 7 includes land 702, water 706, such as a lake, and a shoreline 704. The shoreline 704 is a location where the water 704 abuts the land 702 or has eroded due to water 702, wind, ice heaving, or other causes.

Figure 8:
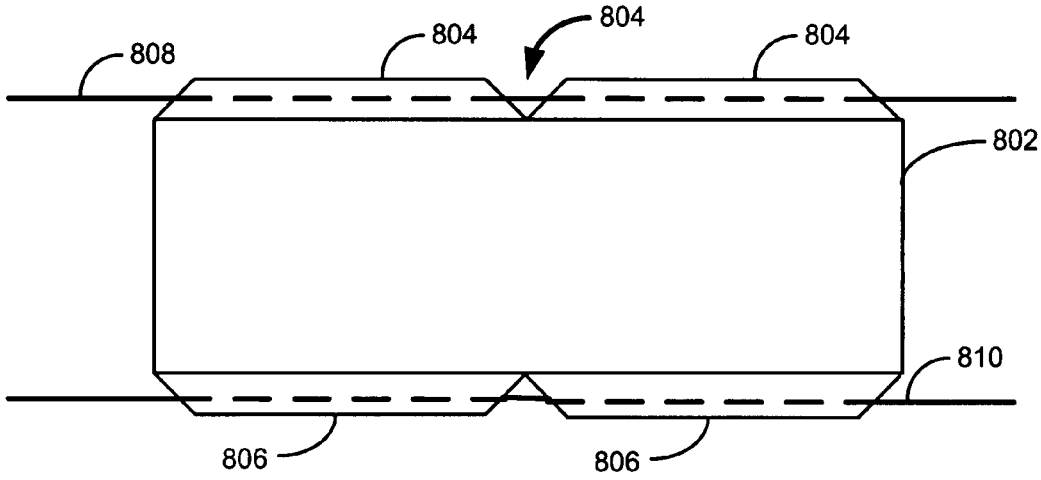
FIG. 8 illustrates a media containment system according to an example embodiment.

FIG. 7 also includes containment systems 710, which may be alternatively referred to herein and by others as shoreline restoration modules and the like. The containment systems 710, in some embodiments, may be installed along the shoreline 704 and backfilled between the land and the containment systems 710 to restore the shoreline 704 to a restored shoreline 708. In some embodiments, as illustrated in FIG. 8, the containment systems 710 may form a fabric sheet to cover and contain a media, such as one or more of cornstalk, hay, straw, jute, and other organic and inorganic materials. The containment systems 710, when installed with a media, are installed along the shoreline 704 and anchored, such as by using ropes threaded through anchoring channels formed on opposite sides of the formed sheet and secured to stakes driven into the shoreline 704 or land 702. The use of the multiple containment systems 710 in a linear, and sometimes vertical, configuration anchored along the shoreline 704 allows substantial conformity to commonly irregular terrain along shoreline 704.

FIG. 8 illustrates a media containment system 802 including anchoring elements according to an example embodiment. The anchoring elements include first anchoring channels 804 and a second anchoring channel 806. A first anchoring rope 808 is threaded through the first anchoring channels 804. A second anchoring rope 810 is threaded through the second anchoring channels 806. The first anchoring channels 804 and second anchoring channels 808, in some embodiments, may be of equal or varying length along opposite sides of the containment system 802. In some embodiments, rather than having multiple anchoring channels along the opposite sides of the containment system 802, each opposite side may include a single, continuous anchoring channel. The anchoring channel one each side may then be cut into, such as by using a knife or scissors, to create an anchoring point. In these and other embodiments, additional anchoring points may be added at will to allow for greater anchoring strength to the shoreline if needed, or to cause the containment system 802 to conform more closely to an irregularly shaped shoreline.

The media containment system 802 is typically rectangular having two longer sides opposite one another and two shorter sides opposite one another. The length of the longer sides and the shorter sides may vary depending on the requirements of a specific embodiment or requirements for a shoreline to be restored. The lengths in some embodiments may be 25 feet by four feet, 25 feet by six feet, 50 feet by one of two, four, six, eight, or other measurement of greater or lesser length, or in between. In other embodiments, it is contemplated that the length of one or both of the longer sides and shorter sides may be of a made-to-order size. For example, if an installer desires to use a single media containment system 802 to restore a great length, it is contemplated that some embodiments may be several hundred feet long or even longer.

The media containment system 802, when installed, is installed over the top of a media, such as corn stalks or other media as discussed above. The media containment system 802, with the anchoring channels 804, 806 provides an alternative structure for fulfilling and accomplishing the same tasks and functions as discussed with regard to the other embodiments described herein.

Figure 9:
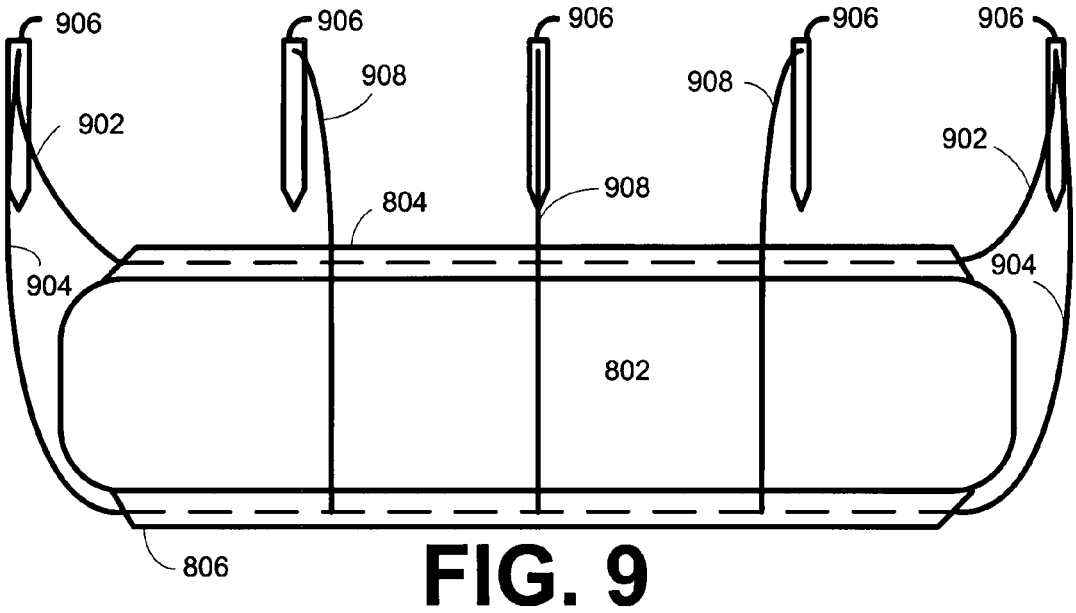
FIG. 9 illustrates an installed media containment system according to an example embodiment.

FIG. 9 illustrates an installed media containment system 802 according to an example embodiment. To secure the media containment system 802, in some embodiments, media may be first placed along a shoreline and then essentially wrapped with the media containment system 802. In other embodiments, the media containment system 802 may be first partially anchored and then backfilled with media.

When installed the media containment system 802 includes an upper anchoring rope 902 and a lower anchoring rope 904 threaded through the anchoring channels 804, 806 and secured with stakes 906 driven into the shoreline or a distance back from there. Additional securing ropes 908 may be added to secure to one or more of the upper anchoring rope 902 and lower anchoring rope 904 and secured with additional stakes 906. Any number of additional anchoring ropes 908 and stakes may be added as needed. Note that the media containment system 802 illustrated in FIG. 9 includes single, continuous anchoring channels 804, 806. However, in the illustrated embodiment, the anchoring channels 804, 806 would have been cut into to allow for the additional anchoring ropes 908 to be secured to the upper anchoring rope 902 and lower anchoring rope 904. The ends of the media containment system 802 may be pulled tightly against the shoreline with the upper anchoring rope 902 and lower anchoring rope 904. In other embodiments, the media containment system 802 may include a drawstring type end closing arrangement or maybe closed with other mechanisms such as stakes.

Such embodiments as described and illustrated herein provide a durable, yet degradable shoreline restoration system constructed by layering a natural absorbent material within a durable, porous yet degradable synthetic fabric. The selected of each material may vary without departing from the inventive nature of the subject matter herein. Further, embodiments herein provide anchoring systems and methods that sustain wear over a period, such as five years, that allows vegetation to grow to re-anchor the restored shoreline with root structure of plants.

Some further embodiments provide a shoreline restoration system including one or more media bales, each media bale enclosed in a bag. The bags in such embodiments may include a photodegradable fabric exterior lined with a burlap fabric forming the bag including a closed end and an open end and first and second anchoring channels through which an anchoring line is threaded, the first and second anchoring channels formed from at least one of the photodegradable and burlap fabrics. The bags may also include a drawstring channel formed from one or more of the first and the second fabric at the open end of the bag, the drawstring channel having a drawstring threaded there through substantially closing the open end of the bag. When installed, the bags include a first anchoring rope threaded though a first anchoring channel of one or more bags and secured to first and second anchoring stakes and a second anchoring rope threaded through a second anchoring channel of the one or more bags and secured to the first and second anchoring stakes. Some such shoreline restoration systems may further include, for each bag enclosing a media bale, a piece of photodegradable fabric sized and positioned to cover at least an area of the media bale inside the open end of the bag which would otherwise be exposed when the open end of the bag is closed.

Some embodiments, such as embodiments utilizing a cornstalk media bales have been found to retain water for extended periods while sequestering nutrients. As a result, plants that spread or may be planted directly into installed containment modules, such as by plugs of grasses or other plants, are able to continue growing when waterlines recede. At the same time, nutrient run off, such as nitrate and phosphate rich fertilizers, is reduced before flowing into the body of water. For example, with regard to water retention, after saturation of an assembled containment module to a point where it held 39 gallons of water, measured by weight, the containment module still retained 10 gallons of water, measured by weight, following 63 days of exposure to air. With regard to nutrient filtering, a containment module was found to filter out 72 percent of nitrates and 58 percent of phosphates.

Although the embodiments described and illustrated herein have been in the context of shoreline restoration, the containment modules may also be used to retain soil along slopes, such as hillsides. When installed in such a manner, the containment modules slow and filter runoff water as it flows down the slope reducing, or preventing, slope erosion caused by water flows. At the same time, such reduction in erosion often helps stabilize soil to allow vegetation to grow where it otherwise may have been unable to grow.

It is emphasized that the Abstract is provided to comply with 37 C.F.R. §1.72(b) requiring an Abstract that will allow the reader to quickly ascertain the nature and gist of the technical disclosure. It is submitted with the understanding that it will not be used to interpret or limit the scope or meaning of the claims.

In the foregoing Detailed Description, various features are grouped together in a single embodiment to streamline the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

It will be readily understood to those skilled in the art that various other changes in the details, material, and arrangements of the parts and method stages which have been described and illustrated in order to explain the nature of this invention may be made without departing from the principles and scope of the invention as expressed in the subjoined claims.

What is claimed is:

1. A shoreline restoration module comprising:

a first fabric and a second fabric forming a bag having a closed end and an open end, the first fabric lining an interior of the formed bag and the second fabric forming an exterior surface of the bag;

first and second anchoring channels formed from one or more of the first and the second fabric, the first and second anchoring channels extending outward from the bag, and formed including anchoring lines threaded there through; and a drawstring channel formed from one or more of the first and the second fabric at the open end of the bag, the drawstring channel having a drawstring threaded there through to substantially close the open end of the bag.

2. The shoreline restoration module of claim 1, wherein the first fabric is a burlap fabric.

3. The shoreline restoration module of claim 2, wherein the burlap fabric is an untreated ten-ounce burlap fabric including jute fiber.

4. The shoreline restoration module of claim 1, wherein the second fabric is a photodegradable fabric.

5. The shoreline restoration module of claim 4, wherein the photodegradable fabric is a woven polymer-based fabric.

6. The shoreline restoration module of claim 5, wherein the photodegradable, woven polymer-based fabric has a shade factor of at least 60 percent and a weight of 4.25 ounces per square yard.

7. The shoreline restoration module of claim 1, wherein the photodegradable fabric is a tan color.

8. The shoreline restoration module of claim 1, wherein the drawstring is ⅛ inch diamond braid multifilament polypropylene rope.

9. The shoreline restoration module of claim 1, further comprising:

an end-cap formed of at least the second fabric to be placed inside the open-end of the bag when closed using the drawstring.

10. The shoreline restoration module of claim 1, wherein the bag is sized to hold a media bale.

11. The shoreline restoration module of claim 10, wherein the media bale is a cornstalk bale.

12. A shoreline restoration system comprising:

one or more media bales, each media bale enclosed in a bag, wherein the bag includes:

a photodegradable fabric exterior lined with a burlap fabric forming the bag including a closed end and an open end;

first and second anchoring channels through which an anchoring line is threaded, the first and second anchoring channels formed from at least one of the photodegradable and burlap fabrics, the first and second anchoring channels extending outward from the bag; and a drawstring channel formed from one or more of the first and the second fabric at the open end of the bag, the drawstring channel having a drawstring threaded there through substantially closing the open end of the bag a first anchoring rope threaded though the first anchoring channel of one or more bags and secured to first and second anchoring stakes; and a second anchoring rope threaded through the second anchoring channel of the one or more bags and secured to the first and second anchoring stakes.

13. The shoreline restoration system of claim 12, further comprising:

for each bag enclosing a media bale, a piece of photodegradable fabric sized and positioned to cover at least an area of the media bale inside the open end of the bag which would otherwise be exposed when the open end of the bag is closed.

14. The shoreline restoration system of claim 12, wherein the first and second anchoring stakes are at least two feet long and are driven into a shoreline.

15. The shoreline restoration system of claim 12, wherein the one or more media bales are cornstalk bales.

16. The shoreline restoration system of claim 12, further comprising:

a third anchoring rope attached to the first anchoring rope at a hole formed in the first anchoring channel of one of the one or more bags and attached to a third anchoring stake.

* * * * *